United States Patent [19]

Hooper

[11] Patent Number: 4,642,189

[45] Date of Patent: Feb. 10, 1987

[54] ROTARY SCREEN OF THE VERTICAL PRESSURE TYPE HAVING PULP STOCK FEED AT DIFFERENT AXIAL POSITIONS ON THE SCREEN

[75] Inventor: Anthony W. Hooper, Quebec, Canada

[73] Assignee: Uniweld Inc., Sherbrooke, Canada

[21] Appl. No.: 703,451

[22] Filed: Feb. 20, 1985

Related U.S. Application Data

[63] Continuation of Ser. No. 560,248, Dec. 12, 1983, abandoned.

[51] Int. Cl.[4] ..... B01D 29/42; B07B 1/20

[52] U.S. Cl. ..... 210/405; 162/55; 209/240; 209/273; 210/413; 415/121 G; 416/198 R

[58] Field of Search ..... 209/240, 270, 273, 279, 209/280, 283, 300, 305, 306; 210/213, 214, 360.1, 377, 380.1, 405, 456, 512.1, 787, 413; 162/55; 415/121 G; 416/198

[56] References Cited

U.S. PATENT DOCUMENTS

| | | | |
|---|---|---|---|
| 68,356 | 9/1867 | Evans | 210/377 X |
| 310,469 | 1/1885 | Schlatter | 210/405 |
| 1,134,304 | 4/1915 | Westbye | 209/273 |
| 3,081,873 | 3/1963 | Cowan et al. | 209/273 |
| 3,400,820 | 9/1968 | Nelson | 209/273 |
| 3,713,536 | 1/1973 | Hooper | 209/273 |
| 4,066,547 | 1/1978 | Hoks | 210/377 X |
| 4,268,381 | 5/1981 | Hooper | 209/273 |
| 4,374,728 | 2/1983 | Gauld | 209/273 |

*Primary Examiner*—Richard V. Fisher
*Assistant Examiner*—W. Gary Jones
*Attorney, Agent, or Firm*—Larson and Taylor

[57] ABSTRACT

A rotary pulp screening device of the vertical type is disclosed having a high screening efficiency and high capacity. The screen provides a streamline flow of pulp-stock, and aims to supply a fairly constant flow of pulp through the screen from top to bottom, thus utilizing the full height of the screen. The screening device includes a cylindrical housing with a vertical cylindrical screen therein, a rotary impeller mounted for rotation within the screen, the impeller having a body whose top is substantially level with the disc ring and bottom is adjacent the lower end of the cylindrical screen, the body having a shape with circular axial cross section from the top to the bottom, whose diameter increases from the top to the bottom thus leaving a larger annular space at the top, and impeller blades radiating from at least a portion of the body of the impeller and extending to within a short distance from the screen for the height of the screen. The improvement comprises at least one substantially frusto-conical shaped baffle concentric with the body of the impeller, extending down from the top of the screen adapted to divide flow of pulp stock entering the screening device, and direct the divided flows to different vertical locations on the pulp screen.

17 Claims, 14 Drawing Figures

ROTARY SCREEN OF THE VERTICAL PRESSURE TYPE HAVING PULP STOCK FEED AT DIFFERENT AXIAL POSITIONS ON THE SCREEN

This application is a continuation of application Ser. No. 560,248 filed Dec. 12, 1983, now abandoned.

The present invention relates to rotary screening of pulp stock and more particularly to improvements in both the method and the device for screening pulp stock in pressure screens.

The screening of a wood pulp slurry is necessary in the production of paper to remove large fibers, shives and other rejects. Over the years equipment and processes to screen the pulp have improved. Initially pulp stock was passed through a vibrating screen, an improvement of this method was a cylindrical pulsating method where foils were rotated inside a screen to produce a pulsating effect on a mat of fibers adjacent the screen. The present method, and the one that is used in most modern paper mills, is the rotating method where fibers are screened in a cylindrical screen, generally a vertical screen. A series of impeller blades rotate inside the screen, and pulp slurry is fed to the top of the screen. As the slurry passes through the screen, the fibers are formed into a mat between the screen plate and the impeller blades, the mat rotates due to the movement of the impeller blades and at the same time has an axial movement downwards so that the reject particles in the pulp stock are held in the mat and conveyed to the bottom of the screen where they are removed in a reject chamber. The mat should retain substantially the same thickness from top to bottom, the rotating impeller blades prevent the mat from becoming too thick and causing fibers to plug holes in the screen plate.

As disclosed in U.S. Pat. No. 3,713,536 and U.S. Pat. No. 4,268,381, it is preferred to have a pulp stock flow through the pulp screening device to follow an approximate parabolic curve. To these ends the main shape of the impeller has been arranged so the distance between the screen and the impeller face at the top of the impeller is considerably more than the distance between the screen and the impeller face at the bottom of the impeller. The aim of both these prior art designs is to provide a streamline flow of pulp stock through the screening device and also to ensure that the full height of the screen is used. If the mat of fibers down the screen varies in thickness, plugging of the screen can occur and some screen areas do not screen fibers. This results in the screening device working inefficiently.

Inasmuch as the impeller blades rotate at a constant speed, it is assumed that the mat between the blades and the face of the screen also rotates at a substantially constant speed. However, in the past it has not always been possible to ensure that the thickness of the mat and the axial speed of the pulp stock in the mat of fibers adjacent the screen is constant for the full height of the screen. It is, therefore, a purpose of the present invention to direct fresh pulp stock to the screen plate at points axially distant from the inlet end of the pulp screen and thus utilize the full height of the pulp screen. This introduction of fresh pulp stock has the effect of increasing the rate of acceptance of stock through the screen plate at the different axial points, since the highest rate of flow in existing pulp screens is at the inlet where the stock is fresh. It also has the effect of acting as dilution thereby decreasing the need for internal dilution water at the different axial points. The resulting machine maintains a substantially constant velocity for the pulp stock in the axial direction down the face of the screen. In addition to this, dilution water is added below the last point of application of pulp stock to the screen to dilute the remaining pulp stock and ensure a reasonably constant velocity of pulp stock, including rejects, down the face of the screen below the axial points of pulp stock applications.

The arrangement of dividing the pulp stock flow into parts, together with the locations where the parts are directed towards the screen, and the quantity of dilution water mixed with the pulp stock below these screen locations, are all variables that can be tuned to suit the geometry of a particular pulp screening device. The highest rate of pulp stock flow always occurs at the inlet end of present day pulp screens, so by having different points on the screen where fresh pulp is applied increases the capacity at those points and consequently increases the capacity of the whole pulp screen.

At the inlet end, the consistency of the pulp stock that has passed through the screen is similar to the consistency of the fresh pulp stock fed to the screen, whereas further down the screen there is a considerable consistency drop. The effect of bringing in fresh pulp stock at different points down the screen is to reduce the overall consistency drop between the pulp stock and the screened pulp stock down the screen. A reduction of this consistency drop is beneficial to the process.

The introduction of fresh pulp stock at different axial points down the screen, coupled with the maintenance of a substantially constant axial velocity of the pulp stock down the screen, has the effect of making the pulp screen unit more stable. It has been observed in field trials that the pulp screen unit of the present invention is more difficult to plug than existing pulp screens, and furthermore, the screen unplugs with only minor corrective action, as compared to existing types of pulp screens.

It has been found that this arrangement of screening pulp stock increases the efficiency of the screen inasmuch as less horsepower is required to rotate the impeller for a similar flow of pulp stock through a known type of screening device. Alternatively, an increased flow of pulp stock may be screened for the same horsepower requirement using a known type of screening device.

The present invention provides in a rotary pulp screening device of the vertical pressure type, including a cylindrical housing having an upper inlet chamber and a lower screening chamber with a disc ring dividing the upper chamber from the lower chamber, vertical cylindrical screen within the lower chamber, rotary impeller mounted for rotation about a central vertical axis within the screen, the impeller having a body whose top is substantially level with the disc ring and bottom is adjacent the lower end of the cylindrical screen, the body having a shape with circular axial cross section from the top to the bottom, whose diameter increases from the top to the bottom thus leaving a larger annular space at the top, and an annular inlet between the disc ring and the top of the body, means for rotating the impeller, impeller blades radiating from at least a portion of the body of the impeller and extending to within a short distance from the screen for the height of the screen, and pulp discharge outlet from the lower chamber outside the pulp screen, the improvement comprising at least one substantially frusto-conical shaped baffle, concentric with the body of the impeller, extending down from the annular inlet, adapted to divide flow of pulp stock entering the annular inlet, the baffle forming an annular axial cross sectional opening between the baffle and the body of the impeller having a substantially similar cross sectional area at the inlet end as at the bottom of the baffle, and the baffle joined exteriorly to the impeller blades.

In another embodiment the opening between the baffle and the body of the impeller has no impeller blades therein.

In an embodiment of the invention, a frusto-conical inlet ring may be provided in the upper chamber extending upwards from the disc ring, with the smallest diameter at the top of the inlet ring, and the rotary impeller has a cone portion formed to the paraboloidal segment shaped body to form an approximate paraboloid shape. The axial height of the baffle is preferably about 20% of the height of the cylindrical screen and dilution water is preferably applied to the cylindrical screen below the baffle. In another embodiment the impeller has a paraboloidal segment shaped body, which may be formed from a plurality of frusto-conical segments. In a still further embodiment the impeller has a frusto-conical shaped body.

In yet a further embodiment, two baffles are provided one above the other, positioned such that the flow of pulp stock entering the annular inlet is divided into three parts, a first part passing through a first annular space between the top of the first baffle and the disc ring, a second part passing through a second annular space between the bottom of the first baffle and the top of the second baffle, and a third part passing through a third annular space between the bottom of the second baffle and the surface of the body of the impeller. In yet a further embodiment, three baffles may be provided, this embodiment is particularly useful in high screens. Again the height of each baffle is preferably about 20% of the height of the cylindrical screen. A still further embodiment provides for a plurality of baffles, extending downwards one below the other.

In a still further embodiment there is provided a rotary impeller adapted to rotate inside a cylindrical screen of a pulp screening device of the vertical pressure type, the impeller comprising a body having a shape with circular axial cross section from top to bottom whose diameter increases from the top to the bottom, impeller blades radiating from at least a portion of the body of the impeller and extending to within a short distance from the screen for the height of the screen, at least one substantially frusto-concial shaped baffle concentric with the body of the impeller, extending down from the top of the impeller, adapted to divide flow of pulp stock, the baffle forming an annular axial cross sectional opening between the baffle and the body of the impeller having a substantially similar cross sectional area at the inlet end as at the bottom of the baffle, the baffle joined exteriorly to the impeller blades.

There is also provided in a process of screening a pulp stock in a rotary pulp screening device of the vertical pressure type including, a cylindrical housing having an upper inlet chamber and a lower screening chamber with a disc ring dividing the upper chamber from the lower chamber, vertical cylindrical screen within the lower chamber, rotary impeller mounted for rotation about a central vertical axis within the screen, the impeller having a body whose top is substantially level with the disc ring and bottom is adjacent the lower end of the cylindrical screen, the body having a shape with circular axial cross section from the top to the bottom thus leaving a larger annular space at the top, and an annular inlet between the disc ring and the top of the body, means for rotating the impeller, impeller blades radiating from at least a portion of the body of the impeller and extending to within a short distance from the screen for the height of the screen, and pulp discharge outlet from the lower chamber outside the pulp screen, wherein pulp stock entering the annular inlet is rotated by the impeller blades, flows down the screen and mixes with dilution water, the pulp stock passing through the screen for substantially the full height of the screen and exiting through the pulp discharge, the improvement comprising the steps of: dividing the flow of pulp stock entering the annular chamber into a plurality of parts before the pulp stock is rotated by the impeller blades, directing each of the parts at a different vertical location on the screen such that the velocity of pulp stock down the screen is substantially constant, and adding dilution water, if necessary, to the pulp stock at further vertical locations on the screen below the locations where the parts are directed such that the velocity of the pulp stock down to the bottom of the screen remains substantially constant.

In yet a further embodiment the flow of pulp stock is divided into a plurality of equal parts, the first part directed at the top of the screen and the remaining parts directed at distances apart representing about 20% of the height of the screen.

In drawings which illustrate the embodiments of the invention,

Figure 1:
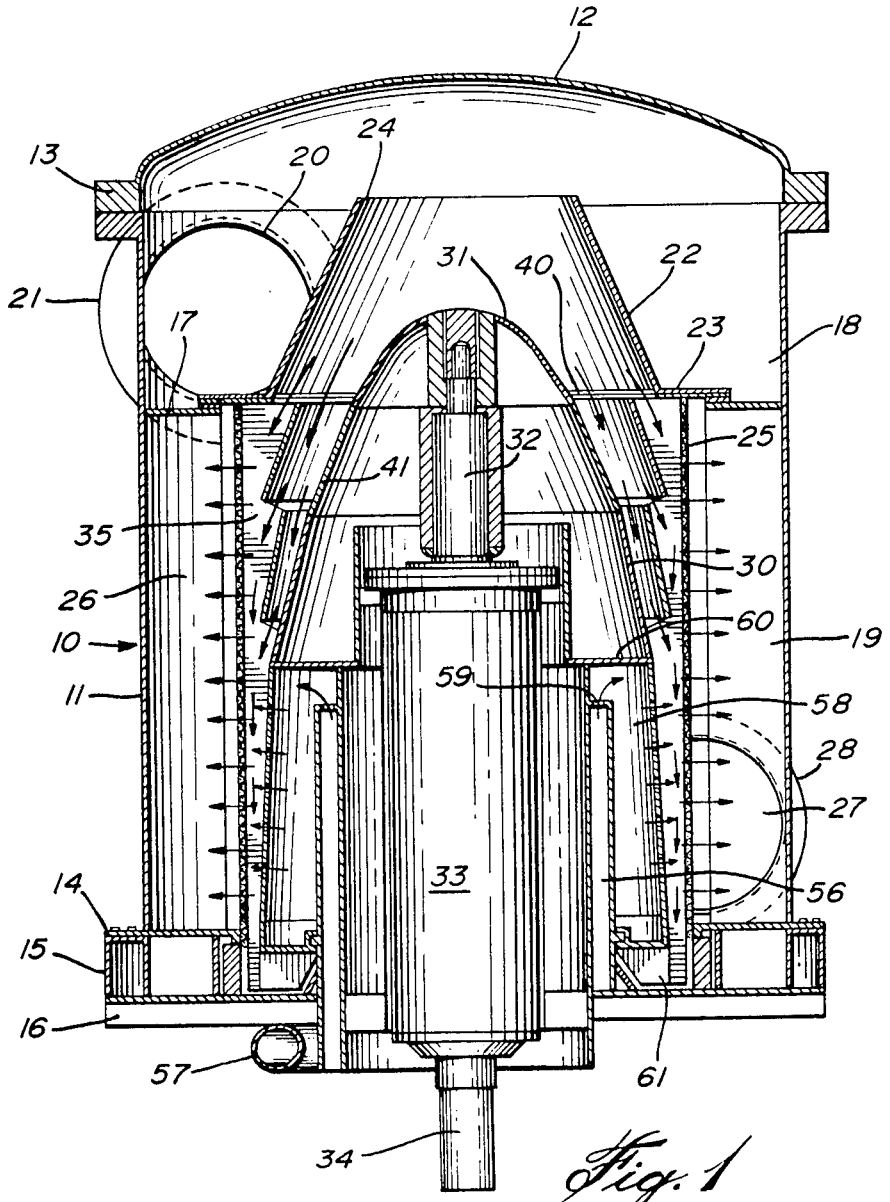
FIG. 1 is a vertical section of one embodiment of a rotary pulp screening device of the present invention with two baffles.

One embodiment of a pulp screening device 10 is shown in FIG. 1 having a generally cylindrical housing 11 with a top cover 12 joined to the cylindrical housing 11 at flange 13. The cylindrical housing 11 has a lower flange 14 which rests on a casing bottom flange 15 supported on a base plate 16.

In the cylindrical housing 11, spaced down from the top flange 13, is a disc ring 17, which divides the housing into an upper inlet chamber 18, above the disc ring 17, and a lower screening chamber 19, below the disc ring 17. A tubular inlet pipe 20, having a flange 21, at the end thereof provides entry to the inlet chamber 18. A conical inlet ring 22 has a lower flange 23, at its largest diameter which rests on the disc ring 17. The lower flange 23, overlaps the disc ring 17, so that pulp stock passing into the inlet chamber 18, moves up the conical side of the inlet ring 22, and passes over the small diameter lip 24, flowing downwards through the conical inlet ring 22, into the lower chamber 19.

A vertical cylindrical screen 25, is mounted axially in the lower chamber 19, and extends for the full height of the chamber 19, from the lower flange 14, to the disc ring 17. An accept chamber 26, is provided in the lower chamber 19, outside the screen 25. An outlet 27, at the bottom of the accept chamber 26, in the cylindrical housing 11, outside the screen 25, allows the screened accept fibers to leave the screening device 10. A flange 28, at the end of the outlet 27, provides a connection to discharge ducts.

A rotary impeller 30, is positioned axially within the screen 25. In the embodiment shown, the rotary impeller 30, in the screening area is shaped approximately in the form of a paraboloid segment. The paraboloid segment is formed from a series of truncated cones joined together and has a curved nose cone 31, on the top so the overall shape of the impeller is paraboloidal. The impeller 30, is made in this manner for ease of construction but the approximate paraboloid shape provides streamline flow to the screen. In the embodiment shown, the nose cone 31, extends up into the conical inlet ring 22, of the upper chamber 18. The tip of the nose cone 31, may be the same height as the top of the screen 25. Thus, that portion of the impeller 30, within the screening area forms what is referred to as a paraboloidal segment. In other embodiments the nose cone 31, may be omitted. The shape of the impeller may be formed from only two truncated cones with different slopes as disclosed in U.S. Pat. No. 3,713,536, dated Jan. 30, 1973.

The present invention can be applied to existing rotary screens by retrofitting a new impeller in an existing screen. The retrofit impeller may have a frusto-conical shape rather than a paraboloid shape or two different truncated cones with different shapes.

The rotary impeller 30, is mounted on a rotating axial shaft 32, which rotates in a bearing assembly 33, on the axis of the cylindrical screening device 10. The lower drive shaft 34, may have a V-belt pulley (not shown) mounted thereon for connection by means of V-belts to an electric motor.

A number of impeller blades 35, are equi-spaced about the rotary impeller 30, radiating from at least a portion of the body of the impeller 30. The blades 35, extend to within a short distance from the screen 25, for the full height of the screen 25, leaving an annular space 36, between the tips of the blades 35, and the screen 25. Details of the arrangement of rotor blades 35, and impeller 30, are shown in more detail in FIGS. 2–5. An annular inlet 40, is formed at the top of the paraboloidal segment shaped body of the impeller 30, at the level of the disc ring 17, where the pulp stock passes from the inlet ring 22, into the lower screening chamber 19. A top baffle 41, having a substantially frusto-conical shape is located concentric with the surface of the impeller 30 extending down from the annular inlet 40. The top baffle 41 is shown substantially parallel with the surface of the impeller 30 for the height of the top baffle 41. It is not essential for the baffle 41 to be parallel to the surface of the impeller 30, however, it is necessary for the annular axial cross sectional opening between the baffle 41 and the surface of the impeller 30 to have a substantially similar cross sectional area for the full height of the baffle 41. By keeping this cross sectional area constant for the height of the baffle, the velocity of the pulp stock passing between the baffle 41, and the surface of the impeller 30, remains about the same. The baffles are described as being frusto-conically shaped, however, they may be flat or curved, dependent upon the shape of the impeller surface and are designed to provide constant velocity to the pulp stock flowing therein. A second frusto-concial shaped baffle 42, also concentric with the surface of the impeller 30, is positioned below the top baffle 41, leaving an aperture 43, between the bottom of the top baffle 41, and the top of the second baffle 42. Like the top baffle 41, the second baffle 42, is shown as being substantially parallel to the surface of the impeller 30, for the height of the second baffle 42. As in the case of the top baffle 41, the cross ectional area between the second baffle 42, and the surface of the impeller 30, is substantially the same for the height of the second baffle 42. The annular space between both baffles 41 and 42 and the surface of the impeller 30, may have no impeller blades therein, and therefore is open. However, the impeller blades 35, radiate outward from the baffles 41 and 42 to the annular space 36, so that the tips of the blades 35, extend for the full height of the screen. In a preferred embodiment the annular space between the impeller blades 41 and 42, and the surface of the impeller 30, is open, that is to say no impeller baffles extend through this space so that initially when pulp stock enters this area it is not immediately rotated by the action of the impeller blades 35.

The positioning of the two frusto-conical baffles 41, and 42 divides the flow of pulp stock entering the pulp inlet 40, into separate parts, two baffles provide three parts of pulp stock flow directed at different heights down the pulp screen 25. In the embodiment shown the position of the top baffle 41 in the annular inlet 40 is such that the pulp stock flow is divided into two parts, a first part which flows outside the top baffle 41, between the top baffle 41 and the bottom of the inlet ring 22, into the impeller blades 35, where it is immediately rotated by the impeller blades. Much of this first part of the pulp stock passes through the top portion of the screen 25, however, a rotating mat of fibers is formed, and there is an axial flow of pulp stock vertically down the screen. The second part of the pulp stock flow entering the annular inlet 40 flows down the surface of the impeller 30, and in the preferred embodiment is not subjected to substantial rotation. The first part and the second part of pulp stock flow may be about equal, or the second part may be twice that of the first part, depending upon the arrangement of baffles. The second part is then divided into two separate and substantially equal parts at the bottom of the top baffle 41. The first of these two equal parts exits through aperture 43, and is immediately rotated by the impeller blades. Much of the pulp stock in this second part joins the rotating mat of fibers and passes through the screen, however, there is an axial vertical movement of the pulp stock in the mat of fibers down the surface of the screen. This movement is at substantially the same speed as the movement of the first part of the pulp stock entering at the top of the screen 25. The last part of the pulp stock exits through aperture 44, at the bottom of the second baffle 42, between the second baffle 42 and the surface of the impeller 30, and as in the case of the other parts of pulp is immediately rotated by the impeller blades 35, forming into the rotating mat of fibers. Some of the pulp stock passes through the screen and there is a movement of the pulp stock in the mat of fibers axially down the screen at the same speed as the other two parts of pulp. The vertical height of each of the baffles 41 and 42 is preferably substantially the same, each baffle has a vertical height of approximately 20% of the total height of the cylindrical screen 25.

Thus, in the embodiment shown pulp stock entering the annular inlet 40, is in effect divided, and three parts of pulp are delivered to the impeller blades 35, and consequently to the pulp screen 25, at different heights along the pulp screen 25. The height of the baffles and the position of the baffles is determined primarily by the flow characteristics entering the annular inlet 40. Other considerations include the type of screen and the type of pulp stock being screened. The criteria is to ensure that the axial movement of pulp stock moving down the screen has substantially the same velocity from top to bottom of the screen.

Figure 2:
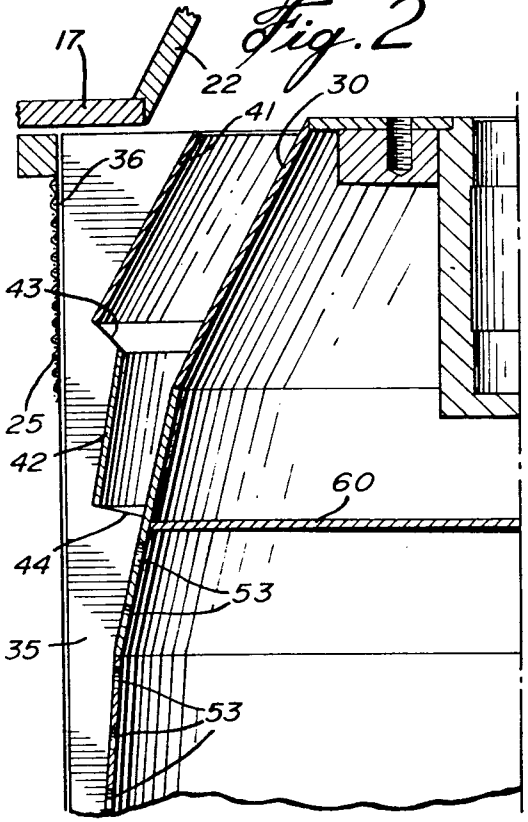
FIG. 2 is a partial vertical section of FIG. 1 showing a detail of the baffles for separating the flow of pulp stock to the screen.

Whereas two baffles are shown in FIGS. 1 and 2, small pulp screening devices may have only one baffle therein, tall pulp screening devices may have three or more baffles. Again the criteria being that the axial velocity of the pulp stock down the screen is arranged to be substantially the same from top to bottom of the screen.

Figure 3:
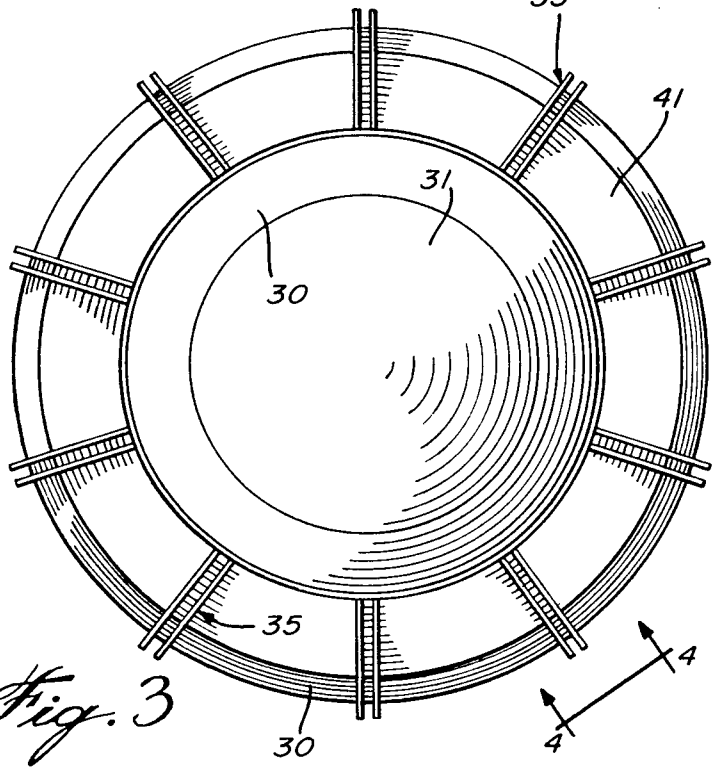
FIG. 3 is a top plan view of the impeller and rotor blades for the screening device shown in FIG. 1.
Figure 4:
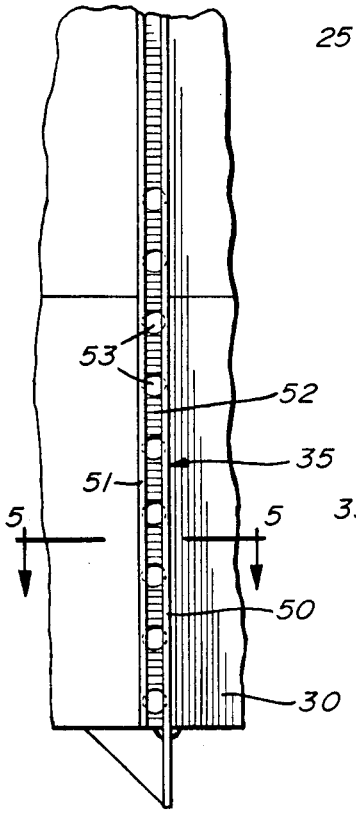
FIG. 4 is a vertical elevation of one pair of impeller blades at line 4—4 of FIG. 3.
Figure 5A:
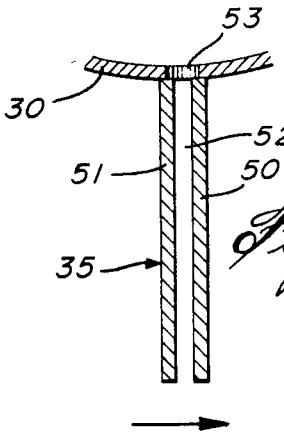
FIGS. 5A to 5G are sectional views taken at line 5—5 of FIG. 4 showing different embodiments of impeller blades.

Different types of impeller blades 35, may be incorporated with rotary pulp screen of the present invention. One type of impeller blade is illustrated in FIGS. 3, 4 and 5A, and other types are illustrated in FIGS. 5B to 5G. The selection of impeller blades is made dependent upon a number of factors such as the type of pulp stock being screened, the desired properties of the screened pulp, and the capacity of the pulp stock through the rotary pulp screen. These listed factors are by no means limiting, neither do they represent the only factors.

The impeller blades 35, shown in FIGS. 3, 4 and 5A have a first leading blade 50, and a second trailing blade 51, which are spaced apart with a gap 52 therebetween the blades 50 and 51, to allow dilution water to be sprayed directly from the body of the impeller 30, below the lower baffle 42, and have a plurality of holes 53, in the gap 52, between the blades 50 and 51 to allow dilution water to be sprayed directly onto the pulp screen 25. Thus, dilution water is added at locations on the pulp screen 25, below where the parts of pulp stock are fed onto the screen. Sufficient dilution water is applied such that the axial velocity of the mat of fibers moving down the face of the screen remains the same or substantially the same for the full height of the screen 25.

Figure 5B:
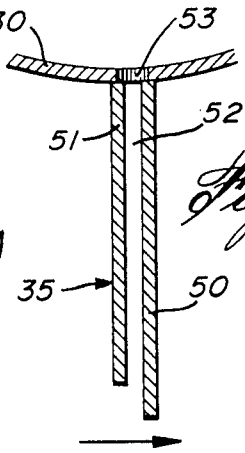
Figure 5C:
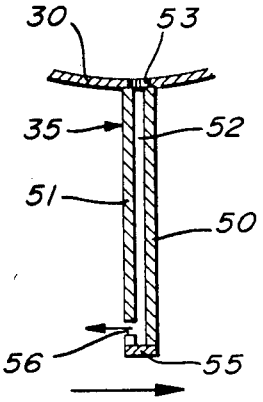
Figure 5D:
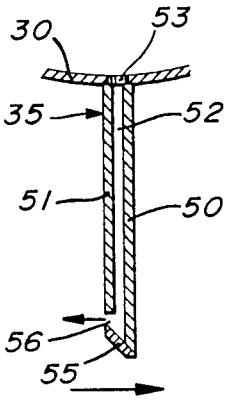
Figure 5E:
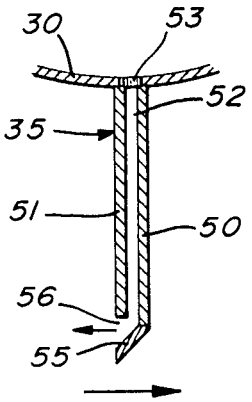
Figure 5F:
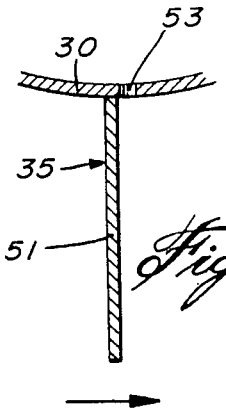
Figure 5G:
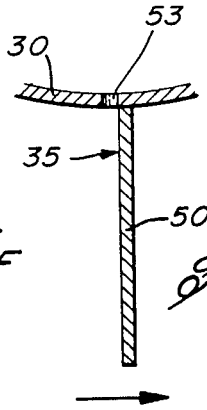

In FIG. 5B, the leading blade 50, extends to within a short distance from the screen, and the second trailing blade 51, does not extend so far. FIGS. 5C, 5D, and 5E illustrate an impeller blade assembly with a cap 55, across the ends of the leading blade 50, and the trailing blade 51, and an exit aperture 56, in the trailing blade 51, for the dilution water. FIGS. 5F and 5G show a single trailing blade 51, and leading blade 50 respectively without a second blade. The dilution water is fed to the screen directly from the hole 53, in the body of the impeller 30. In all embodiments shown, different flows of dilution water are provided down the screen to ensure that the axial velocity of pulp stock is substantially constant down the screen.

A water inlet duct 57, shown in FIG. 1 leads to an annular chamber 58, having an opening 59 at the top thereof, allowing dilution water to pass into that portion of the ineterior of the impeller body that is beneath the lower baffle 42. A diaphragm plate 60, extending across the body of the impeller 30, prevents dilution water passing into the top of the impeller body.

In one embodiment a reject chamber 61, is provided beneath the screen 25, and as shown in FIG. 4, an impeller blade 50, extends down into the reject chamber 61, to continually sweep the chamber. In another embodiment there is virtually no reject chamber. An outlet (not shown) is provided so that fiber rejects, shives, etc., which pass down the screen and do not pass through the screen, exit from the reject chamber or from the bottom of the screen.

By introducing fresh pulp stock at points down the screen, a higher rate of flow is achieved for the rotary pulp screening device of the present invention. Furthermore, it has been found that the power requirement to rotate the impeller is reduced. This drop in power requirement is believed to be due to the fact that there is a more even use of the pulp screen for its full height, the mat is believed to be substantially the same thickness from top to bottom, and fibers do not clog up any one area of the screen but flow through the screen for its full height from top to bottom. The majority of the pulp stock does not pass through the top portion of the screen as in most existing pulp screens of the vertical pressure type. This complete use of the screen combined with the streamline flow through the aperture between the impeller and the screen improves the utilization of the pulp screening device. As the pulp stock moves to the screen surface the impeller blades rotate the pulp stock and a mat of pulp fibers is formed between the edges of the blades and the screen. This mat rotates relative to the screen and also has an axial movement which is at a substantially constant velocity right down to the reject chamber 61. Due to this rotational and axial movement of the mat, the thickness of the mat remains about the same for the screen height and a shearing force occurs between one side of the mat and the tips of the impeller blades which prevents the holes in the cylindrical screen from plugging. The accept pulp fibers pass through the fiber mat which is formed by the shives and other reject fibers, together with the accept fibers, and then pass through the screen into the accept chamber 26. This axial movement of the mat is substantially constant down the face of the screen, and in order to retain its speed after the lower baffle 42, the dilution water ensures that the mat continues its rotation and downward movement. By having separate dilution water supplies, one supply may be at a higher pressure or higher flow than the other supplies to ensure the axial velocity of the mat is substantially the same down the height of the screen. The rejects in the mat then pass into the reject chamber 61, where they are ejected through the outlet. The accept or screened pulp stock passes out of the accept chamber 26, through the outlet 27.

Field tests carried out on the pulp screening device shown in FIG. 1, arranged the positioning of the baffles 41 and 42 so that fresh feed stock entering the annular inlet 40 was divided, 48% by weight feeding inside the first baffle 41, and this portion was divided equally, half exiting between the first baffle 41, and second baffle 42, and half exiting below the second baffle 42. Of the 52% of pulp stock feeding from the annular inlet directly to the pulp screen, 24% passed through the screen, and 28% flowed down the screen. At the point where the fresh pulp stock exited between the first baffle 41, and second baffle 42, mixing occurred with 24% of the total pulp stock passing through the screen, and 28% continuing down the screen. At the point below the second baffle where the final 24% of fresh pulp stock was added to mix with the 28% continuing down the screen, the addition of dilution water assisted in 37% of this pulp stock to pass through the screen leaving a reject fraction of about 15%. Thus of the total pulp, 85% is screened and becomes the accept fraction and 15% does not pass through the screen and is the reject fraction.

Figure 6:
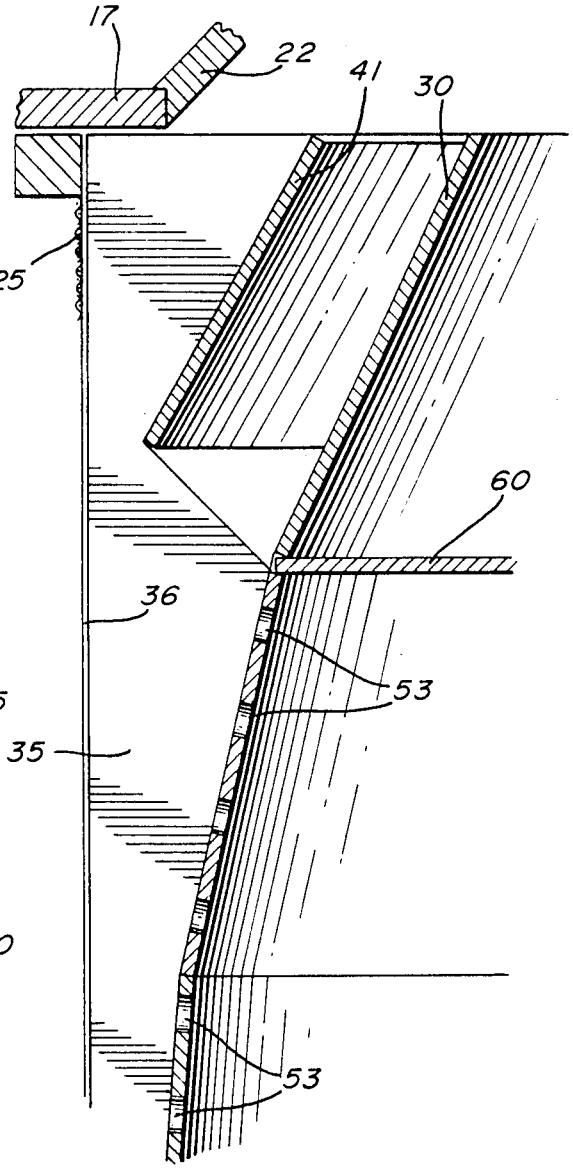
FIG. 6 is a partial vertical section of another embodiment of a rotary pulp screening device having one baffle.
Figure 8:
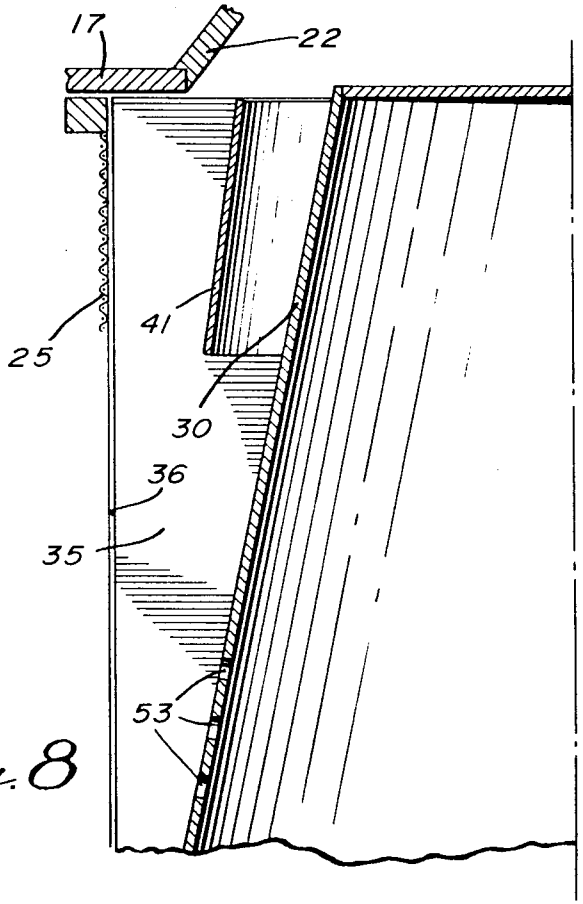
FIG. 8 is a partial vertical section of a rotary pulp screening device having a frusto-conical shaped impeller body and a single baffle.
Figure 7:
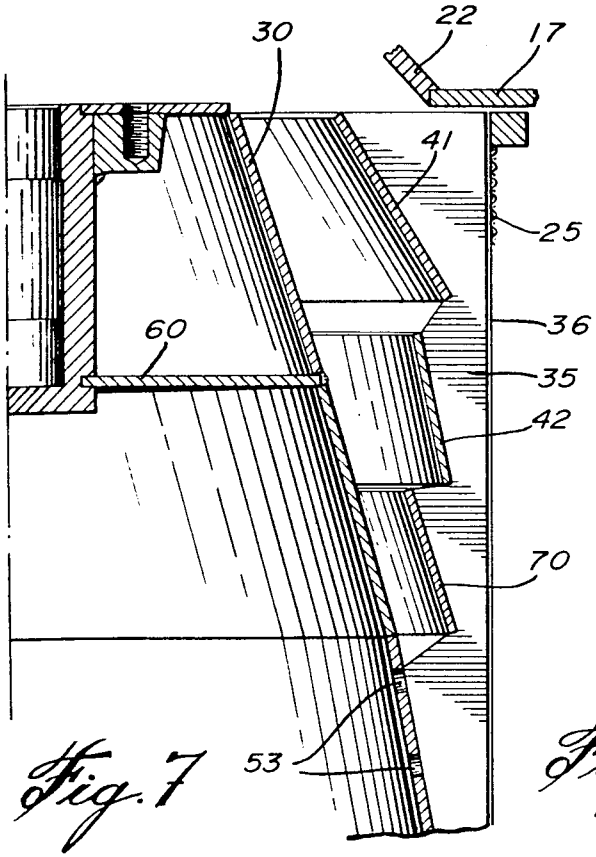
FIG. 7 is a partial vertical section of yet a further embodiment of a rotary pulp screening device having three baffles.

FIG. 6 shows another embodiment of the pulp screening device with only one baffle 41. FIG. 7 shows a pulp screeing device with three baffles, a first baffle 41, second baffle 42 and a third baffle 70. The spacing between the three baffles is such that the pulp stock flow entering inside the first baffle 41, is divided into three substantially equal parts when exiting between the first baffle 41, and second baffle 42, between the second baffle 42, and the third baffle 70, and below the third baffle 70. FIG. 8 shows an impeller 30, which has a frusto-conical shape, and only one slope from the top to bottom. A single baffle 41, is illustrated. This type of impeller would likely be provided to be installed in older types of pulp screening devices.

It will be apparent to those skilled in the art that changes and variations may be made to the pressure pulp screening device of the present application without departing from the scope of the present invention which is limited only by the following claims.

The embodiments of the invention in which an exclusive property or privilege is claimed are defined as follows:

1. In a rotary pulp screening device of the vertical pressure type, including a cylindrical housing having means defining an upper inlet chamber and a lower screening chamber with a disc ring dividing the upper chamber from the lower chamber, vertical cylindrical screen within the lower chamber, rotary impeller mounted for rotation about a central vertical axis within the screen, the impeller having a body whose top is adjacent to the disc ring and bottom is adjacent the lower end of the cylindrical screen, the body having a shape with a circular axial cross section from the top to the bottom, whose diameter increases from the top to the bottom, thus leaving a larger annular space at the top, and means defining an annular inlet between the disc ring and the top of the body, means for rotating the impeller, impeller blades radiating from at least a portion of the body of the impeller and extending to within a short distance from the screen for the height of the screen, and means defining a pulp discharge outlet from the lower chamber outside the pulp screen, the improvement comprising:

at least one substantially frusto-conical shaped baffle with the upper and lower edges of said baffle being disposed in parallel planes, said baffle being disposed in the annular space between the body of the impeller and the screen and extending down from the annular inlet, said baffle being joined to the impeller blades and having a shape to conform to the shape of the body of the impeller to define an annular axial cross sectional opening between the baffle and the body of the impeller with the opening having a substantially equal horizontal cross sectional area from the top of the baffle to the bottom of the baffle, said baffle forming means dividing the flow of pulp stock entering the annular inlet so that a portion of the pulp stock entering the annular inlet passes across the exterior surface of the baffle and a portion of the pulp stock entering the annular inlet passes between the baffle and the body of the impeller and whereby the substantially equal horizontal cross sectional area from the top to the bottom of the baffle maintains a substantially constant axial velocity of the pulp stock passing between the baffle and the body of the impeller.

2. The rotary pulp screening device according to claim 1 wherein the opening between the baffle and the body of the impeller has no impeller blades therein.

3. The rotary pulp screening device according to claim 1 wherein a frusto-conical inlet ring is provided in the upper chamber extending upwards from the disc ring, with the smallest diameter at the top of the inlet ring, and the rotary impeller has a cone portion formed to a paraboloidal segment shaped body to form an approximate paraboloid shape.

4. The rotary pulp screening device according to claim 3, wherein the axial height of the baffle is about 20% of the height of the cylindrical screen.

5. The rotary pulp screening device according to claim 3 including means for applying dilution water to the cylindrical screen below the baffle.

6. The rotary pulp screening device according to claim 1 wherein the impeller has a paraboloidal segment shaped body.

7. The rotary pulp screening device according to claim 6, wherein the paraboloidal segment shaped body is formed from a plurality of frusto-conical segments.

8. The rotary pulp screening device according to claim 1, wherein the impeller has a frusto-conical shaped body.

9. The rotary pulp screening device according to claim 1 wherein two substantially frusto-conical shaped baffles are provided, a first baffle concentric with the body of the impeller, extending down from the annular inlet, a second baffle concentric with the body of the impeller extending down from beneath the first baffle, the two baffles positioned such that the flow of pulp stock entering the annular inlet is divided into three parts, a first part passing through a first annular space between the top of the first baffle and the disc ring, a second part passing through a second annular space between the bottom of the first baffle and the top of the second baffle, and a third part passing through a third annular space between the bottom of the second baffle and the surface of the body of the impeller.

10. The rotary pulp screening device according to claim 9, wherein the axial height of each baffle is about 20% of the height of the cylindrical screen.

11. The rotary pulp screening device according to claim 9, including means for applying dilution water to the cylindrical screen below the baffles.

12. The rotary pulp screening device according to claim 1, wherein three substantially frusto-conical shaped baffles are provided, one extending downwards below the other.

13. The rotary pulp screening device according to claim 12, wherein the axial height of each baffle is about 20% of the height of the cylindrical screen.

14. The rotary pulp screening device according to claim 1, wherein a plurality of substantially frusto-conical shaped baffles are provided, one extending downwards below the other.

15. A rotary impeller adapted to rotate inside a cylindrical screen of a pulp screening device of the vertical pressure type, the impeller comprising:

a body having a shape with circular axial cross section from top to bottom whose diameter increases from the top to the bottom, impeller blades radiating from at least a portion of the body of the impeller and extending to within a short distance from the screen for the height of the screen, at least one substantially frusto-conical shaped baffle concentric with the body of the impeller, the upper and lower edges of said baffle being disposed in parallel planes, said baffle being joined to the impeller blades and having a shape to conform to the shape of the body of the impeller to define an annular axial cross sectional opening between the baffle and the body of the impeller with the opening having a substantially equal horizontal cross sectional area from the top of the baffle to the bottom of the baffle, said baffle forming means dividing the flow of pulp stock so that a portion of the pulp stock passes across the exterior surface of the baffle and a portion of the pulp stock passes between the baffle and the body of the impeller and whereby the substantially equal horizontal cross sectional area from the top to the bottom of the baffle maintains a substantially constant axial velocity of the pulp stock passing between the baffle and the body of the impeller.

16. The rotary impeller as claimed in claim 15, wherein the axial height of the baffle is about 20% of the height of the cylindrical screen.

17. The rotary impeller as claimed in claim 15, wherein a plurality of substantially frusto-conical shaped baffles are provided, one extending downwards below the other.

* * * * *